US009976397B2

(12) United States Patent
Yang et al.

(10) Patent No.: US 9,976,397 B2
(45) Date of Patent: May 22, 2018

(54) SHAPED CHARGE SYSTEM HAVING MULTI-COMPOSITION LINER

(71) Applicant: Schlumberger Technology Corporation, Sugar Land, TX (US)

(72) Inventors: Wenbo Yang, Sugar Land, TX (US); James Guilkey, Salt Lake City, UT (US); Lawrence A. Behrmann, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 418 days.

(21) Appl. No.: 14/628,353

(22) Filed: Feb. 23, 2015

(65) Prior Publication Data

US 2016/0245053 A1 Aug. 25, 2016

(51) Int. Cl.
*F42B 1/028* (2006.01)
*E21B 43/117* (2006.01)
*F42B 1/032* (2006.01)

(52) U.S. Cl.
CPC ..... *E21B 43/117* (2013.01); *F42B 1/032* (2013.01)

(58) Field of Classification Search
CPC ..... F42B 1/032; F42B 1/028; F42B 1/036; F42B 3/28; C06B 45/30; E21B 43/117
See application file for complete search history.

(56) References Cited

U.S. PATENT DOCUMENTS 2,856,850 A * 10/1958 Church ..... F42B 1/02 102/307
3,478,685 A * 11/1969 Thomanek ..... F42B 1/028 102/306
4,436,033 A * 3/1984 Precoul ..... F42B 1/028 102/307
4,498,367 A 2/1985 Skolnick et al.
4,499,830 A * 2/1985 Majerus ..... F42B 1/032 102/307
4,537,132 A * 8/1985 Sabranski ..... F42B 1/028 102/307
4,672,896 A * 6/1987 Precoul ..... F42B 1/024 102/309
5,614,692 A * 3/1997 Brown ..... F42B 1/028 102/307

(Continued)

FOREIGN PATENT DOCUMENTS

EP 0860679 A2 8/1998

OTHER PUBLICATIONS

International Search Report and Written Opinion dated Aug. 23, 2013, for International Patent Application No. PCT/US2013/041039, filed May 15, 2013, 12 pages.

(Continued)

*Primary Examiner* — Michael D David

(57) ABSTRACT

A technique facilitates perforation, including the perforation of a casing and formation. A shaped charge is formed with a case, a liner, and a high explosive material located between the case and the liner. The liner is formed of a powder material, e.g. a powder metal material. The powder material properties of the liner between an apex of the liner and a skirt of the liner may be selectively varied to provide a desired jet velocity and jet mass of the liner upon detonation of the high explosive material.

12 Claims, 3 Drawing Sheets

(56) References Cited

U.S. PATENT DOCUMENTS 5,656,791 A * 8/1997 Reese ..... F42B 1/032 102/307
5,753,850 A * 5/1998 Chawla ..... F42B 1/02 102/307
5,792,977 A * 8/1998 Chawla ..... F42B 1/028 102/307
6,012,392 A * 1/2000 Norman ..... B22F 3/16 102/307
6,021,714 A * 2/2000 Grove ..... E21B 43/117 102/307
6,305,289 B1 * 10/2001 Mayseless ..... E21B 43/117 102/307
6,349,649 B1 * 2/2002 Jacoby ..... F42B 1/028 102/306
6,378,438 B1 * 4/2002 Lussier ..... F42B 1/032 102/306
6,588,344 B2 7/2003 Clark et al.
7,011,027 B2 3/2006 Reese et al.
7,712,416 B2 5/2010 Pratt et al.
7,762,193 B2 * 7/2010 Grove ..... E21B 43/116 102/306
8,156,871 B2 * 4/2012 Behrmann ..... F42B 1/028 102/306
8,166,882 B2 * 5/2012 Yang ..... F42B 1/028 102/306
8,302,534 B2 * 11/2012 Yang ..... F42B 3/08 102/306
8,375,859 B2 * 2/2013 Sagebiel ..... F42B 1/028 102/306
8,449,798 B2 * 5/2013 Walker ..... B22F 3/03 264/109
8,555,764 B2 * 10/2013 Le ..... E21B 43/117 102/310
8,584,772 B2 * 11/2013 Yang ..... E21B 43/116 166/55.1
8,734,960 B1 * 5/2014 Walker ..... F42B 1/028 102/306
8,985,024 B2 3/2015 Yang et al.
9,175,936 B1 * 11/2015 Collier ..... F42B 1/032
9,188,413 B2 * 11/2015 McLean ..... F42B 1/028
9,238,956 B2 * 1/2016 Martinez ..... E21B 43/117
9,360,222 B1 * 6/2016 Collier ..... F42B 1/036
9,441,924 B1 * 9/2016 Frericks ..... F42B 1/028
9,470,483 B1 * 10/2016 Wang ..... F42B 3/22
9,612,095 B2 * 4/2017 Smart ..... F42B 1/032
2003/0183113 A1 10/2003 Barlow et al.
2004/0200377 A1 10/2004 Collins et al.
2004/0255812 A1 12/2004 Bourne et al.
2007/0051267 A1 3/2007 Meddes et al.
2008/0289529 A1 11/2008 Schilling
2012/0234194 A1 9/2012 Glenn

OTHER PUBLICATIONS

International Search Report issued in related PCT application PCT/US2016/018921 dated May 19, 2016, 3 pages.
International Preliminary Report on Patentability issued in the related PCT application PCT/US2016/018921 dated Aug. 29, 2016 (9 pages).
International Preliminary Report on Patentability issued in the related PCT application PCT/US2013/041039 dated Dec. 23, 2014 (7 pages).

* cited by examiner

SHAPED CHARGE SYSTEM HAVING MULTI-COMPOSITION LINER

BACKGROUND

After drilling and casing of an oil or gas well, the well is opened to the surrounding formation for the ingress of oil or gas. The well is opened by perforating the casing and the rock formation beyond the casing using shaped charges. A shaped charge generally comprises a high explosive material located between a case and a liner. A portion of the liner forms a jet which is propelled away from the case when the shaped charge is detonated. The jet is propelled through the casing and into the formation to form a perforation which facilitates the ingress of oil and/or gas.

SUMMARY

In general, a system and methodology are provided for facilitating the perforation of a casing and formation. A shaped charge is formed with a case, a liner, and a high explosive material located between the case and the liner. The liner is formed of a powder material, e.g. a powder metal material. Parameters of the liner, between an apex of the liner and a skirt of the liner, may be selectively varied to provide a desired jet velocity and jet mass of the liner upon detonation of the high explosive material.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
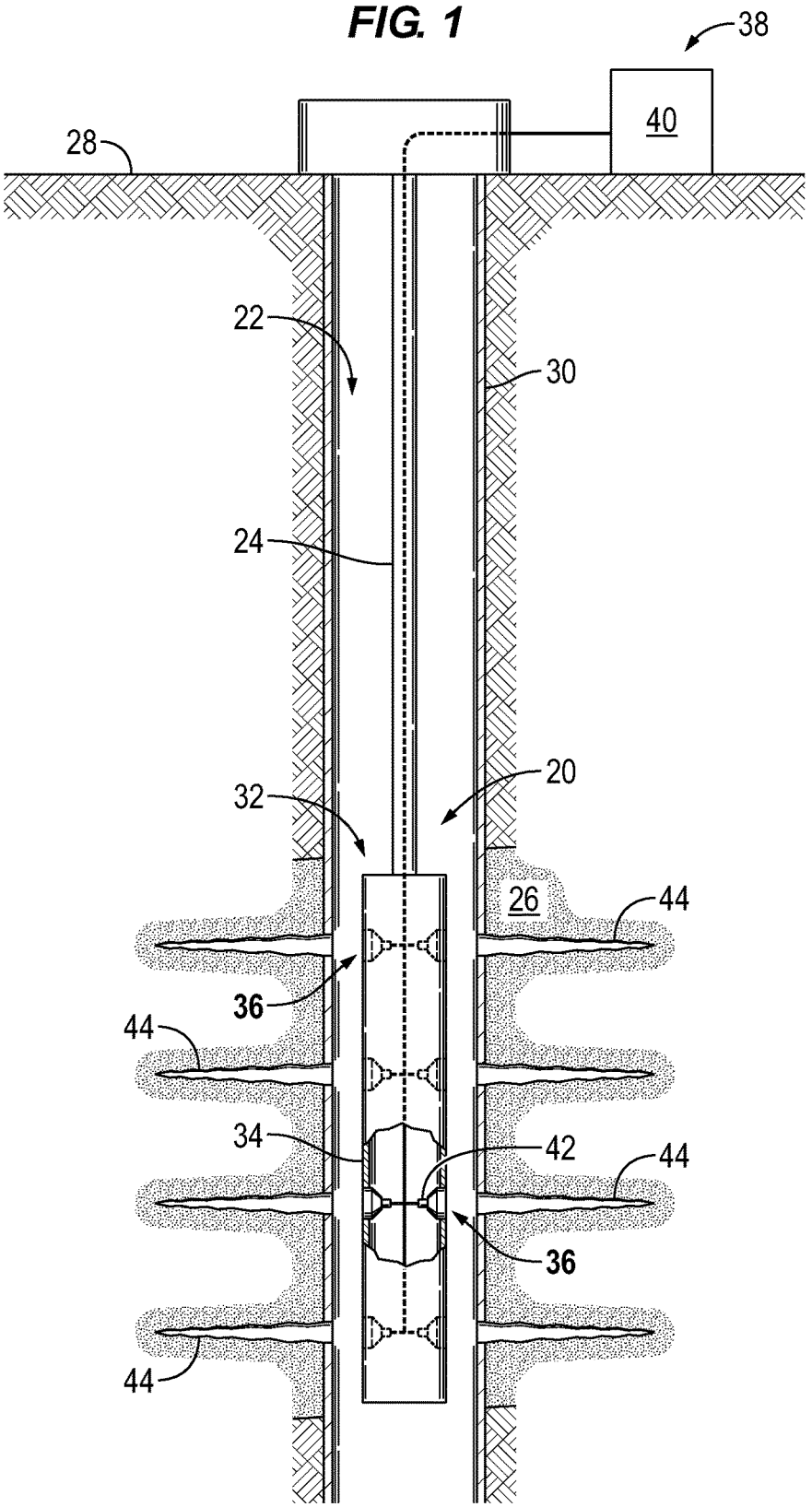
FIG. 1 is a schematic illustration of an example of a perforation system having a plurality of shaped charges deployed in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate perforating, e.g. the perforation of a casing and formation to enhance production from an oil and/or gas well. The perforation may be performed by a perforating gun assembly deployed down into a wellbore via a suitable conveyance. The perforating gun assembly has a perforating gun body designed to hold a plurality of shaped charges oriented outwardly to form perforations into the surrounding formation upon detonation of the shaped charges.

Each shaped charge may be formed with a case, a liner, and a high explosive material located between the case and the liner. The liner is formed of metal and/or non-metal powder material. Upon detonation of the high explosive material, a portion of the liner is propelled as a jet which penetrates through the casing and into the surrounding formation. Characteristics of the jet, e.g. jet velocity and jet mass, may be adjusted by varying one or more characteristics, e.g. one or more compositional parameters, of the liner between an apex of the liner and a skirt of the liner. For example, the density of the powder used to form the liner may be selectively varied between the apex and the skirt of the liner to provide a desired jet velocity and jet mass of the liner upon detonation of the high explosive material. However, additional or other compositional parameters of the liner also may be varied to achieve a desired perforation. Examples of these other compositional parameters include powder particle diameter distribution, hardness, ductility, porosity, and abrasiveness.

In an embodiment, the liner is formed from a powder material having a composition which varies between an apex of the liner and a skirt of the liner. Examples of the powder material include various metal powder materials although other powder materials may be used in the mixture. In some embodiments, ceramic powders or other non-metal powdered materials may be added to vary the mix of powder material between the apex and the skirt of the liner. Depending on the specifics of the application and/or environment, different powder metal mixes including metals alone or combined metals and non-metals may be used between the liner apex and the liner skirt.

The variable powder metal/powder material mixture along the liner may be used to optimize the performance of oilfield perforators. For example, variation in compositional parameters along the liner may be used to achieve deeper penetration, larger casing entrance hole diameter, increased casing hole diameter plus deeper penetration, and other enhancements related to perforating gun exit hole diameter as well as casing/formation penetration characteristics. In some embodiments, the mix of the powder material at the first portion or apex of the liner can be formed with a different powder mixture, say mixture 1, compared to the mix of powder material, say mixture 2, through the remainder of the liner or vice versa.

Referring generally to FIG. 1, an example of a perforating system 20 is illustrated as deployed in a wellbore 22 via a conveyance 24. In this example, the wellbore 22 extends into a subterranean formation 26 from a surface location 28 and is lined with a casing 30. The perforating system 20 comprises a perforating gun 32 having a perforating gun body 34. The perforating gun body 34 may have a variety of structures and may be constructed with many types of components. A plurality of shaped charges 36 is mounted to the perforating gun body 34, and each of the shaped charges 36 is oriented outwardly from the gun body 34.

The shaped charges 36 are connected with a detonation system 38 having a detonation control 40 which provides signals to a detonator or detonators 42 to initiate detonation of shaped charges 36. In many applications, the detonation system 38 may utilize a detonator 42 in the form of detonation cord properly positioned to initiate detonation of the shaped charges 36. When detonator 42 comprises detonation cord, the detonation cord is routed to the shaped charges 36 and portions of the detonation cord are placed into cooperation with explosive material located in the shaped charges 36. In some applications, the shaped charges 36 are placed in a staggered pattern along the perforating gun body 34 and linked by the detonator/detonation cord 42 which is routed back and forth between the staggered shaped charges 36. The detonation cord enables a desired, controlled detonation of the plurality of shaped charges. Upon detonation, the shaped charges 36 explode and create a jet of material which is propelled outwardly to create perforations 44 which extend through casing 30 and into the surrounding subterranean formation 26. The number and arrangement of shaped charges 36 can vary depending on the parameters of a given perforation application. Additionally, the shaped charges 36 may be detonated in separate groups; or a plurality of perforating guns 32 may be employed to perforate different zones of subterranean formation 26.

Figure 2:
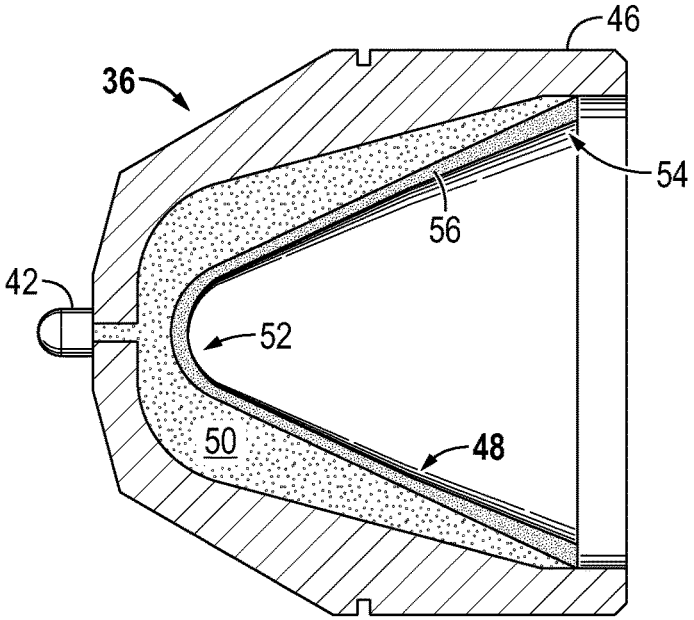
FIG. 2 is a cross-sectional view of an example of a shaped charge, according to an embodiment of the disclosure.

Referring generally to FIG. 2, an example of one of the shaped charges 36 is illustrated. In this embodiment, shaped charge 36 comprises a case 46, a liner 48, and a high explosive material 50, e.g. a high explosive pellet, positioned between the case 46 and the liner 48. The liner 48 extends generally between a first portion or apex 52 and a second portion or skirt 54. By way of example, the liner 48 may be cup-shaped with the apex 52 forming the bottom of the cup and the skirt 54 forming the rim of the cup. The liner 48 is formed with a powder material 56 having characteristics which change between the apex 52 and the skirt 54. In some applications, however, non-powdered material also may be combined into the liner 48 to help provide the changing characteristic or characteristics.

For example, the liner 48 may be constructed such that the powder material 56 has differences in compositional parameters, e.g. powder density or other material properties, moving from the apex 52 to the skirt 54. The differences in material properties may be selected to optimize or otherwise adjust the jet velocity and jet mass of the liner 48 upon detonation of explosive material 50. The changes in compositional parameters may be achieved by utilizing a variety of powder material blends, e.g. mixtures, between the apex 52 and the skirt 54. In some applications, the powder material 56 may have a changing proportion of materials along the axis of the liner 48 (i.e. varied between the apex 52 and the skirt 54) to achieve a desired continuity of liner properties, e.g. continuity of density or mass, with a corresponding, desired jet velocity and jet mass. The changing characteristic, e.g. changing material properties, along the liner 48 may be achieved by a variety of powder material techniques. However, the liner 48 also may be constructed via three-dimensional (3-D) printing techniques which enable variation of material properties, e.g. variation of material compositional parameters, at different regions throughout the liner 48. For example, 3-D printing techniques may be used to control and vary the porosity along liner 48 to obtain desired jet properties.

By way of example, the powder material 56 used to form liner 48 may be a powder metal material. The powder metal material may be formed from various mixtures of metal powders (or metal and non-metal powders) depending on the perforating characteristics desired for a given application. Examples of metal powders include tungsten (W) powder, copper (Cu) powder, lead (Pb) powder, titanium (Ti) powder, and other metal powders. The various metal powders may be mixed in many different types of compositions and those compositions may be varied between the apex 52 and the skirt 54 of liner 48. The composition of the powder metal material 56 and the differences in composition moving from the apex 52 to the skirt 54 is selected to achieve different perforating characteristics upon detonation of the explosive material 50.

The powder material composition and the change in powder material compositional parameters between the apex 52 and the skirt 54 may vary substantially depending on the overall design of the shaped charge 36, casing 30, type of rock in formation 26, and various other system and environmental parameters. Various mixtures of powder materials having different powder material densities, diameter distributions, hardness characteristics, ductility characteristics, and/or abrasiveness characteristics may be used to achieve the desired perforations. It also should be noted that the powder material 56 may comprise non-metal powder components. For example, ceramic powders or other non-metal powders may be used to form portions of liner 48 or they may be mixed with the metal powders to create desired material characteristics and changes in those characteristics moving from the apex 52 to the skirt 54. Different density powder materials such as tungsten powders and ceramic powders may be used in differing concentrations along the liner to create lower density and higher density portions of the liner 48.

Figure 3:
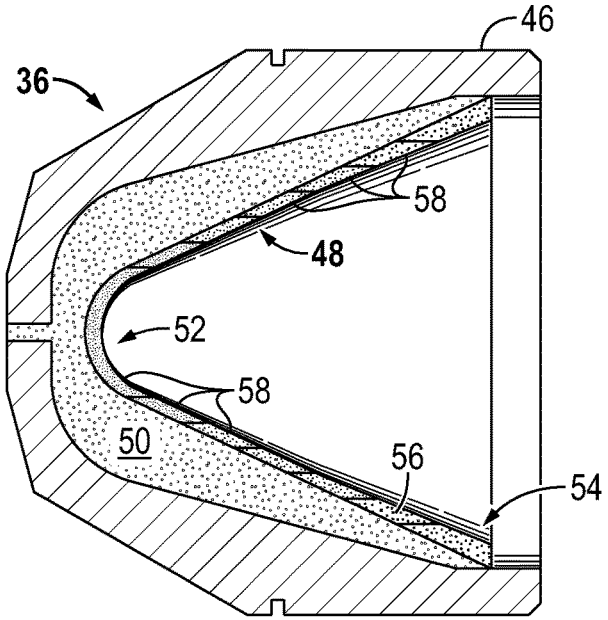
FIG. 3 is a cross-sectional view of another example of a shaped charge, according to an embodiment of the disclosure.

Referring generally to FIG. 3, another embodiment of shaped charge 36 is illustrated. In this embodiment, the liner 48 is constructed of powder material 56 having differing compositions moving from the apex 52 to the skirt 54. The liner 48 is constructed with a plurality of discrete segments 58 in which at least some of the discrete segments 58 have different material compositions relative to each other. The discrete segments 58 may each be formed of different compositions of metal and non-metal powders, as discussed above, to achieve desired perforating characteristics. For example, segments 58 at or close to apex 52 may be formed from lower or higher density powder materials, (e.g. powder materials having lower or higher concentrations of low-density constituents such as tungsten powders or ceramic powders) to achieve a desired jet velocity and jet mass upon detonation of explosive material 50. Depending on the application, the liner 48 may comprise two, three, four, or more different metal and/or non-metal powder material mixtures moving from the apex 52 to the skirt 54. The content and arrangement of those segments 58 can be adjusted depending on the desired perforator performance in any given target.

Figure 4:
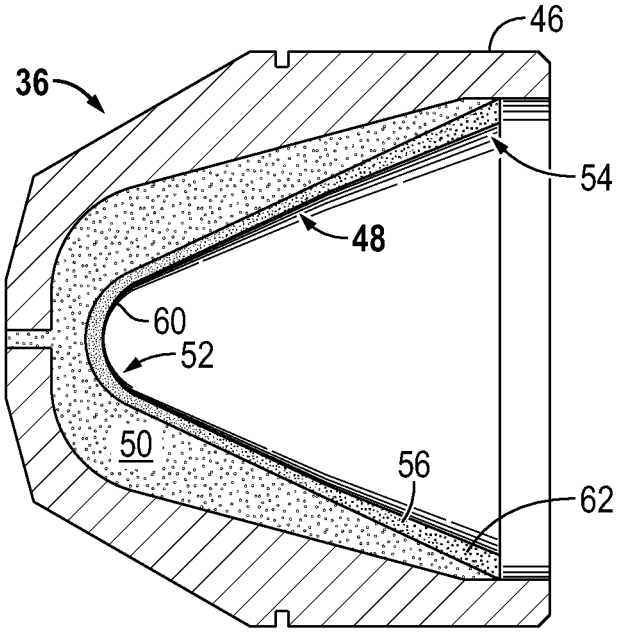
FIG. 4 is a cross-sectional view of another example of a shaped charge, according to an embodiment of the disclosure.

In the embodiment illustrated in FIG. 4, the liner 48 has been constructed with powder material 56 having a material composition which varies continuously from the apex 52 to the skirt 54. The continuous variation of material composition may be based on variation of any of a variety of parameters moving between apex 52 and skirt 54 of liner 48. For example, the density of the powder material 56 forming liner 48 may be varied continuously in an axial direction along the liner 48. In the example illustrated, the density of liner 48 varies continuously from a low-density region 60 located at apex 52 to a higher density region 62 located at skirt 54. The density of the powder material 56 and/or other compositional parameters may be varied to different degrees and in differing directions depending on the desired characteristics of the jet created by liner 48 upon detonation of explosive material 50.

As discussed above, the powder material 56 may incorporate a variety of powder materials, such as tungsten, copper, lead, titanium, ceramic, and/or other types of powder materials. Additionally, the powder material 56 may incorporate a binding material formed as a coating or other type of layer on the powder materials used to form the liner 48. The concentration and/or mixture of components also may be varied between discrete segments 58 of the liner, continuously, or according to other patterns between the apex 52 and the skirt 54 of the liner 48.

When liner 48 is constructed of distinct segments 58, certain compositions of the segments can create sudden density/mass changes which create discontinuities of the jet resulting from detonation of explosive material 50. In some applications, the discontinuities can be useful and in other applications the discontinuities can be reduced or minimized by engaging adjacent liner segments 58 gradually. For example, the plurality of segments 58 may be matched together gradually moving from the apex 52 to the skirt 54. Depending on the application, various structural changes may be made with respect to liner 48 to compensate for the varying parameters of powder material 56 between the apex 52 and the skirt 54.

If, for example, the variable parameter is density, the thickness of the liner 48 may be changed with the changing density. In an embodiment, the lower density region of liner 48 is thinner and the higher density region of liner 48 is thicker to maintain jet continuity. In some applications, discontinuities in the formed jet may be minimized by constructing liner 48 such that the liner 48 has continuity satisfying d(alpha)/dx and d(rho)/dx where alpha is the liner half angle, rho is the liner density, and x is the axial distance along the liner 48.

Liner 48 may be formed in many sizes and structures with various patterns and mixtures of powder material compositions. Additionally, the liner may be combined with many types of cases and explosive materials to construct different types of shaped charges and to achieve desired perforation characteristics. The number and arrangement of shaped charges also may be selected according to the parameters of the perforation application and the structure of the perforating gun assembly. The detonation system and the sequence of detonation also may vary from one application to another.

The variation in the structure of the shaped charge liner and/or in the composition of the shaped charge liner can be used to facilitate perforating in many well related applications. The shaped charges described herein may be used in wells drilled from the Earth's surface and in subsea wells. However, the shaped charges and the shaped charge liners also may be used in non-well applications in which perforations are formed through and/or into a variety of materials. The variable characteristics of the liner may be used to achieve the desired jet for optimized perforation performance in many types of applications.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method, comprising:

placing a high explosive pellet in a shaped charge case;

using a powder metal material to construct a liner having a shape with an apex and a skirt;

adjusting the composition of the powder metal material moving from the apex to the skirt such that the liner has continuity satisfying d(alpha)/dx and d(rho)/dx where alpha is a liner half angle, rho is a liner density, and x is an axial distance along the liner;

placing the liner against the high explosive pellet such that the high explosive pellet is captured between the liner and the shaped charge case to create a shaped charge.

2. The method as recited in claim 1, wherein adjusting comprises creating a lower density region of the liner.

3. The method as recited in claim 1, wherein adjusting comprises using contiguous, discrete segments of powder metal material having different compositional parameters moving from the apex to the skirt.

4. The method as recited in claim 1, wherein adjusting comprises adjusting a compositional parameter of the powder metal material continuously moving from the apex to the skirt.

5. The method as recited in claim 1, further comprising using a low-density powder to create lower density regions in the liner.

6. The method as recited in claim 1, further comprising forming the powder metal material with ceramic powder to create lower density regions.

7. The method as recited in claim 1, further comprising mounting the shaped charge on a perforating gun body; moving the perforating gun body and the shaped charge downhole into a wellbore; and detonating the shaped charge to create a perforation.

8. The method as recited in claim 1, wherein using comprises forming the liner via three dimensional printing.

9. A method, comprising:

forming a shaped charge with a case; a liner formed of a powder metal material; and a high explosive material positioned between the liner and the case; and adjusting a jet velocity and jet mass of the liner by varying a compositional parameter of the liner between an apex and a skirt of the liner such that the liner has continuity satisfying d(alpha)/dx and d(rho)/dx where alpha is a liner half angle, rho is a liner density, and x is an axial distance along the liner.

10. The method as recited in claim 9, further comprising using a non-powder material in the liner.

11. The method as recited in claim 9, wherein adjusting comprises creating the liner with contiguous segments having different powder metal compositions.

12. The method as recited in claim 9, wherein adjusting comprises varying the compositional parameters of the powder metal material continuously from the apex to the skirt.

* * * * *